US009962010B2

(12) United States Patent
Sheldrake

(10) Patent No.: US 9,962,010 B2
(45) Date of Patent: May 8, 2018

(54) MODULAR FURNITURE COVER SYSTEM

(71) Applicant: Treasure Garden, Inc., Baldwin Park, CA (US)

(72) Inventor: Corrine Sheldrake, Winchester, CA (US)

(73) Assignee: TREASURE GARDEN, INC., Baldwin Park, CA (US)

( * ) Notice: Subject to any disclaimer, the term of this patent is extended or adjusted under 35 U.S.C. 154(b) by 374 days.

(21) Appl. No.: 14/328,151

(22) Filed: Jul. 10, 2014

(65) Prior Publication Data

US 2016/0007765 A1 Jan. 14, 2016

(51) Int. Cl.
*A47C 31/00* (2006.01)
*A47C 31/11* (2006.01)
(Continued)

(52) U.S. Cl.
CPC ..... *A47C 31/113* (2013.01); *A47B 97/00* (2013.01); *A47C 15/002* (2013.01)

(58) Field of Classification Search
CPC ..... A47G 9/0253; A47C 31/10; A47C 31/11; A47C 21/022; A47C 27/002
(Continued)

(56) References Cited

U.S. PATENT DOCUMENTS

D105,575 S 5/1937 Easterman
3,117,817 A * 1/1964 Mednick ..... A47C 31/11 297/224
(Continued)

FOREIGN PATENT DOCUMENTS

DE 4111254 10/1992
EP 1481615 12/2004
(Continued)

OTHER PUBLICATIONS

Wicker Central, Forever Patio Wicker 6 Piece Right Facing Sectional Furniture Cover, http://www.wickercentral.com/forever-patio-wicker-hampton-6-piece-right-facing-sectional-sofa-cover.html, Pub. Date unknown, Provided copy obtained Sep. 12, 2016.
(Continued)

*Primary Examiner* — Fenn C Mathew
*Assistant Examiner* — Cynthia Collado
(74) *Attorney, Agent, or Firm* — Knobbe Martens Olson & Bear LLP

(57) ABSTRACT

The disclosure herein provides modular cover systems for protecting furniture and other objects. In an embodiment, a furniture protection system comprises a first cover portion comprising a front surface and a back surface interconnected by a top surface, the first cover portion configured to substantially cover a front, back, and top surface of a first furniture component; and a second cover portion comprising a front surface and a back surface interconnected by a top surface, the second cover portion configured to substantially cover a front, back, and top surface of a second furniture component, wherein a first edge of the first cover portion comprises a first releasable fastener for connecting the first cover portion to the second cover portion, and wherein a second edge of the second cover portion comprises a second releasable fastener configured to engage the first releasable.

7 Claims, 10 Drawing Sheets

(51) Int. Cl.
*A47B 97/00* (2006.01)
*A47C 15/00* (2006.01)

(58) Field of Classification Search
USPC ..... 150/154–167; 297/225, 227, 224, 223, 297/218.1, 218.3, 228, 228.1, 228.11, 297/440.14, 228.13, 9, 283.1
See application file for complete search history.

(56) References Cited

U.S. PATENT DOCUMENTS

| | | | | |
|---|---|---|---|---|
| 3,311,408 | A * | 3/1967 | Sarvas | A47C 31/11 297/218.3 |
| 3,321,240 | A | 5/1967 | Lilienstern et al. | |
| D217,962 | S | 7/1970 | Bucher | |
| 3,589,770 | A | 6/1971 | Kelley | |
| D251,341 | S | 3/1979 | Bodrero | |
| 4,838,610 | A | 6/1989 | Perrin | |
| 5,308,139 | A | 5/1994 | Rieger | |
| 5,320,407 | A * | 6/1994 | Tell | A47C 31/11 297/225 |
| 5,497,819 | A * | 3/1996 | Chiang | B60J 11/00 150/166 |
| 5,553,362 | A | 9/1996 | Stevens | |
| 5,803,539 | A | 9/1998 | Dewar et al. | |
| 5,887,530 | A | 3/1999 | Muller | |
| 6,116,685 | A | 9/2000 | White et al. | |
| D479,427 | S | 9/2003 | Illulian | |
| 6,709,054 | B2 | 3/2004 | Riley et al. | |
| 6,796,609 | B2 * | 9/2004 | Illulian | A47C 31/11 297/218.1 |
| 6,827,407 | B2 | 12/2004 | Niederman et al. | |
| 7,011,367 | B2 | 3/2006 | Riley | |
| 7,172,246 | B1 * | 2/2007 | Itakura | A47C 31/116 297/219.1 |
| 7,204,551 | B2 | 4/2007 | Kahan | |
| 7,472,954 | B2 | 1/2009 | Miller | |
| 7,481,496 | B2 | 1/2009 | Smith | |
| 7,594,695 | B2 | 9/2009 | Noonan | |
| 7,637,567 | B2 | 12/2009 | Neustat et al. | |
| 7,780,232 | B2 * | 8/2010 | Miller | A47C 31/11 297/224 |
| 8,458,873 | B2 | 6/2013 | McConnell et al. | |
| 8,465,093 | B2 | 6/2013 | Janowski | |
| 9,320,353 | B1 | 4/2016 | Elze et al. | |
| D769,789 | S | 10/2016 | Golden | |
| D790,258 | S | 6/2017 | McNair | |
| 2009/0193616 | A1 | 8/2009 | Hendricks et al. | |
| 2012/0212019 | A1 | 8/2012 | Rodriguez et al. | |
| 2014/0326373 | A1 | 11/2014 | D'Amato et al. | |
| 2015/0069804 | A1 * | 3/2015 | Long | B60N 2/6036 297/228.13 |
| 2015/0074912 | A1 | 3/2015 | Simon et al. | |
| 2017/0105545 | A1 | 4/2017 | Lewis et al. | |
| 2017/0156509 | A1 | 6/2017 | Markowitz | |

FOREIGN PATENT DOCUMENTS

| | | |
|---|---|---|
| JP | 11290158 | 10/1999 |
| JP | 2001029184 | 2/2001 |
| JP | 5398931 | 1/2014 |

OTHER PUBLICATIONS

Protective Cover Unit, Treasure Garden Modular Protective Furniture Collection, posted at youtube.com, published Apr. 16, 2015 by Authen TEAK Outdoor Living, © Standard YouTube License, [online], site visited Aug. 1, 2016 and Jun. 28, 2017. Available from Internet, URL: https://www.youtube.com/watch?v=rMuN_AThOsE.

L-Shape Cover, Cabana Coast, posted at cabanacoast.com, posted Dec. 25, 2014, © Cabanacoast.com, online, site visited Feb. 27, 2017. Available from Internet, URL: https://www.cabanacoast.com/blog/protect-investment-outdooer-patio-furniture-covers.

Custom-Fit Outdoor Furniture Sectional Covers, Restoration Hardware, posted at posting date not given; PDF cut sheet dated Mar. 13, 2014, © 2016 RH, online, site visited Aug. 1, 2016. Available from Internet, URL: https://www.restorationhardware.com/catalog/product/product.jsp?productId=prod2320146&categoryId=search.

* cited by examiner

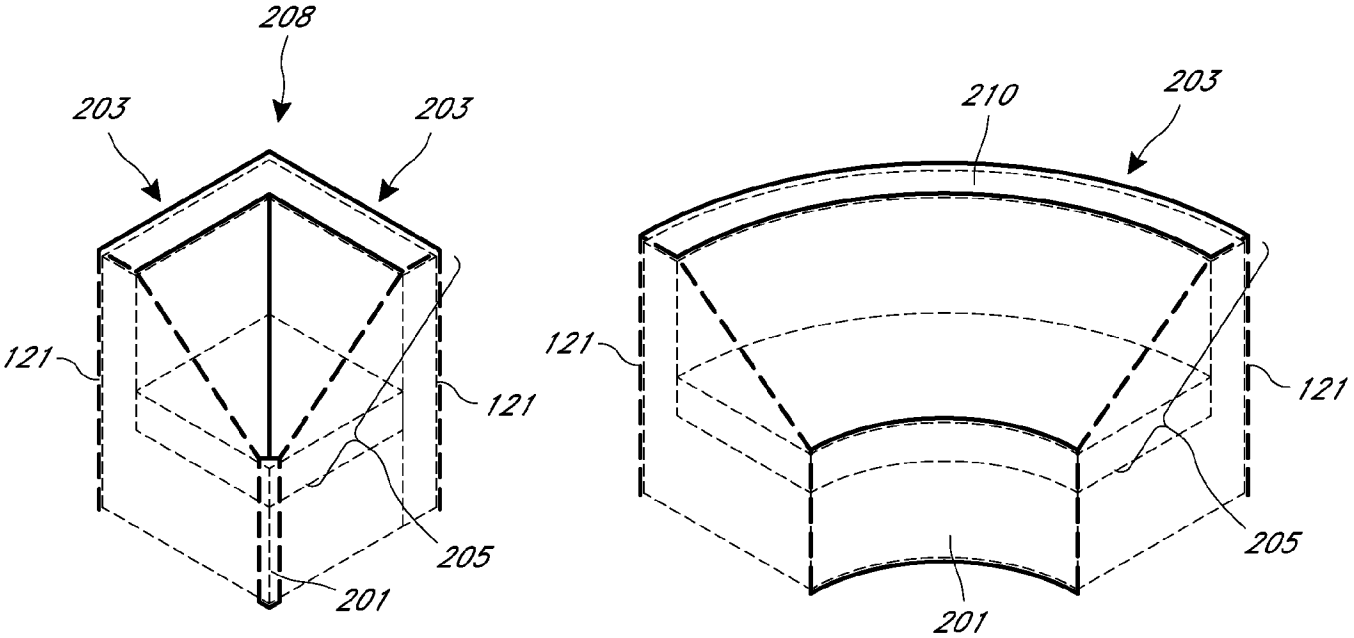
FIG. 2E
FIG. 2F
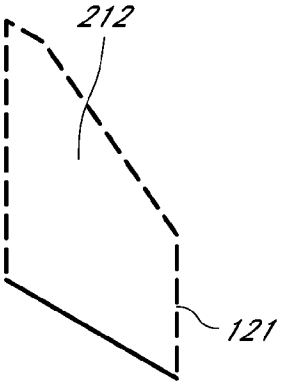
FIG. 2G

MODULAR FURNITURE COVER SYSTEM

BACKGROUND

Field

The disclosure relates generally to the field of protective covers, and more specifically to systems for covering and protecting furniture.

Description

Outdoor furniture is often utilized in residential and commercial settings. For example, homeowners may utilize outdoor furniture on a patio, deck, and/or the like. A business, such as a restaurant, may have an outdoor seating area with outdoor furniture. Furniture used outdoors is subject to degradation by the elements, especially when not in use. For example, furniture may get rained upon, materials may degrade due to ultraviolet light from the sun, and/or the like. One option to protect outdoor furniture from the elements is to manufacture the furniture using weather-resistant materials. However, some weather-resistant materials may not be as comfortable and/or as attractive as materials that are less weather-resistant. Further, even weather-resistant materials may eventually degrade or at least become soiled.

Another option to protect outdoor furniture from the elements is to cover the furniture when not in use. However, outdoor furniture often comes in various sizes and configurations, and may even enable the end-user to change the configuration. The variety of sizes and configurations makes current custom-fit furniture covers impractical and expensive. In some cases, a cheaper universal furniture cover may be made to fit over a variety of different sizes of outdoor furniture. However, such a universal cover may fit the underlying furniture poorly, leading to an unattractive appearance, a loose fit that may enable the cover to blow away, to let the elements in, and/or the like. Accordingly, it can be advantageous to have a modular furniture cover system that is attractive, customizable, effective at keeping out the elements, and cost-effective.

SUMMARY

The disclosure herein presents systems for covering and protecting furniture. In one embodiment a modular furniture cover system comprises a plurality of individual furniture cover components configured to releasably connect to each other to form a unitary furniture cover assembly for protecting one or a plurality of adjacent furniture pieces.

In some embodiments, a furniture cover comprises a front surface dimensioned to substantially cover a front portion of a furniture component; a back surface dimensioned to substantially cover a back portion of the furniture component; and a top surface connecting the front surface and the back surface, the top surface dimensioned to substantially cover a top portion of the furniture component, wherein a first continuous edge formed by the front surface, back surface, and top surface comprises a first releasable fastener for connecting the modular furniture cover to a first separate furniture cover, and wherein a second continuous edge formed by the front surface, back surface, and top surface comprises a second releasable fastener for connecting the modular furniture cover to a second separate furniture cover.

In certain embodiments, the first and second releasable fasteners are water resistant, e.g. waterproof. In some embodiments, the first and second releasable fasteners comprise at least one of a hook and loop fastener and a zipper. In some embodiments, the first separate furniture cover comprises a side panel dimensioned to substantially cover a side portion of the furniture component. In some embodiments, the first separate furniture cover comprises a second modular furniture cover dimensioned to substantially cover top, front, and back portions of a second furniture component. In some embodiments, the first and second continuous edges are positioned on opposite ends of the modular furniture cover. In some embodiments, the furniture cover is configured to at least partially conform to the furniture component when connected to the first and second separate furniture covers. In some embodiments, the top, front, and back surfaces are part of a single sheet of covering material.

In some embodiments, a furniture protection system comprises a first cover portion comprising a front surface and a back surface interconnected by a top surface, the first cover portion configured to substantially cover a front, back, and top surface of a first furniture component; and a second cover portion comprising a front surface and a back surface interconnected by a top surface, the second cover portion configured to substantially cover a front, back, and top surface of a second furniture component, wherein a first edge of the first cover portion comprises a first releasable fastener for connecting the first cover portion to the second cover portion, and wherein a second edge of the second cover portion comprises a second releasable fastener configured to engage the first releasable fastener.

In certain embodiments, the first and second releasable fasteners form a substantially water resistant, e.g. waterproof joint when connected. In some embodiments, the first and second releasable fasteners comprise at least one of a hook and loop fastener and a zipper. In some embodiments, the furniture protection system further comprises a side panel configured to substantially cover a side portion of the first furniture component, the side panel comprising a third releasable fastener configured to connect to the first releasable fastener. In some embodiments, the furniture protection system further comprises a bridge panel to connect the first cover portion to the second cover portion, the bridge panel comprising a third releasable fastener configured to connect to the first releasable fastener and a fourth releasable fastener configured to connect to the second releasable fastener. In some embodiments, the first cover portion comprises a third edge opposite the first edge, the third edge comprising a third releasable fastener.

In some embodiments, a furniture cover system comprises a first furniture cover configured to at least partially cover at least one of a top, front, or back of a first furniture component, the first furniture cover comprising a first releasable fastener positioned adjacent to a first edge; a second furniture cover configured to at least partially cover at least one of a top, front, or back of a second furniture component, the second furniture cover comprising a second releasable fastener positioned adjacent to a second edge, wherein the first and second furniture covers are configured to connect together using the first and second releasable fasteners.

In certain embodiments, the furniture cover system further comprises a bridge panel to connect the first furniture cover to the second furniture cover, the bridge panel comprising a third releasable fastener configured to connect to the first releasable fastener and a fourth releasable fastener configured to connect to the second releasable fastener. In some embodiments, the furniture cover system further comprises a side panel dimensioned to at least partially cover a side of the first furniture component, the side panel comprising a third releasable fastener configured to connect to a fourth releasable fastener of the first furniture cover, the fourth releasable fastener positioned adjacent to a third edge of the first furniture cover, the third edge positioned opposite the first edge. In some embodiments, the furniture cover system further comprises a second side panel dimensioned to at least partially cover a side of the second furniture component, the second side panel comprising a fifth releasable fastener configured to connect to a sixth releasable fastener of the second furniture cover, the sixth releasable fastener positioned adjacent to a fourth edge of the first furniture cover, the fourth edge positioned opposite the second edge. In some embodiments, the first and second releasable fasteners form a substantially water resistant, e.g. waterproof joint when connected. In some embodiments, the first and second releasable fasteners comprise at least one of a hook and loop fastener and a zipper.

In some embodiments, a furniture cover comprises a front surface dimensioned to substantially cover a front portion of a piece of furniture; a back surface dimensioned to substantially cover a back portion of the piece of furniture; a top surface connecting the front surface and the back surface, the top surface dimensioned to substantially cover a top portion of the piece of furniture; and a connection zone disposed adjacent a lateral edge formed by the front surface, back surface, and top surface to enable the furniture cover to be enclosed on a side by connecting an end panel to the connection zone or to enable the furniture cover to be extended beyond the lateral edge to cover an additional piece of furniture by connecting an additional furniture cover to the connection zone.

In certain embodiments, the connection zone comprises a releasable fastener for connecting the furniture cover to the end panel or the additional furniture cover. In some embodiments, the furniture cover is configured to at least partially conform to the piece of furniture when connected to the end panel or the additional furniture cover. In some embodiments, the top, front, and back surfaces are part of a single sheet of covering material. In some embodiments, the releasable fastener is waterproof. In some embodiments, the releasable fastener comprises at least one of a hook and loop fastener and a zipper. In some embodiments, the furniture cover further comprises a second connection zone disposed adjacent a second lateral edge formed by the front surface, back surface, and top surface to enable the furniture cover to be enclosed on a second side by connecting an end panel to the second connection zone or to enable the furniture cover to be extended beyond the second lateral edge to cover an additional piece of furniture by connecting an additional furniture cover to the second connection zone. In some embodiments, the connection zone is positioned opposite to the second connection zone.

BRIEF DESCRIPTION OF THE DRAWINGS

The foregoing and other features, aspects, and advantages of the present invention are described in detail below with reference to the drawings of various embodiments, which are intended to illustrate and not to limit the invention. The drawings comprise the following figures in which:

FIGS. 2A-2G are front perspective views of various embodiments of individual modular furniture covers;

DETAILED DESCRIPTION

Figure 1A:
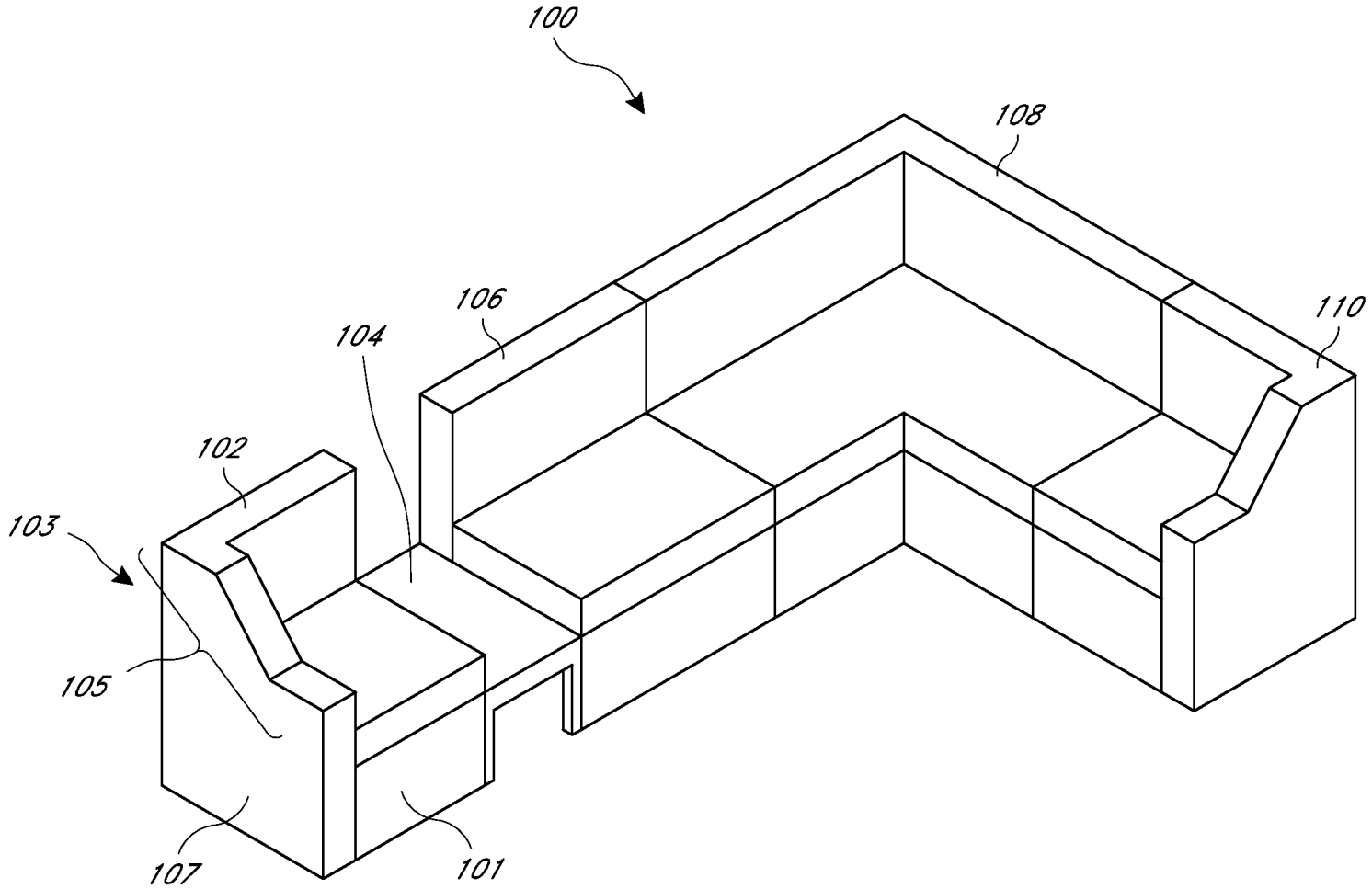
FIG. 1A is a front perspective view of a modular furniture system comprising a plurality of furniture components.

Although several embodiments, examples, and illustrations are disclosed below, it will be understood by those of ordinary skill in the art that the inventions described herein extend beyond the specifically disclosed embodiments, examples, and illustrations and includes other uses of the inventions and obvious modifications and equivalents thereof. Embodiments of the inventions are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described. Further, it should be understood that any of the examples herein are non-limiting. As such, the inventions disclosed herein are not limited to any particular embodiments, aspects, concepts, structures, functionalities, or examples described herein.

Disclosed herein are a variety of embodiments of modular furniture cover systems for covering, for example, outdoor furniture to protect the furniture from the elements. Outdoor furniture, such as seating located at a residential or commercial patio, often comes in various shapes and sizes and is often modular or configurable with several components being joined or pushed together to form a larger unitary seating area. Such outdoor furniture is often of high-quality and/or expensive, so it is desirable to be able to cover the furniture when not in use. However, the modularity of typical outdoor furniture makes mass-market, reasonably priced, and well-fitting covers difficult to produce.

In an embodiment, the disclosure herein provides a plurality of cover pieces that can be joined, connected, affixed, or attached together to enable creation of a unitary furniture cover of a shape or user defined arrangement configured to cover any of a plurality of potential furniture configuration. In some embodiments, the pieces of the modular furniture cover system comprise one or more of a left end, middle, and right end pieces. Modular furniture cover pieces can be coupled together using a variety of joining or fastening means, such as a zipper, a Velcro® or hook and loop fastener, an adhesive, a pressure-sensitive fastener, rope, cord, a heat-activated adhesive, and/or the like. In some embodiments, the cover pieces are configured to be removably connected. In other words, the cover pieces are configured to be relatively easily connected and disconnected by the end user. This can be advantageous to enable a user to change the cover configuration when the underlying furniture configuration changes. In some embodiments, however, the cover pieces are configured to be permanently or semi-permanently connected. For example, a modular furniture cover system can be configured to enable an end-user to customize a size and/or shape of a unitary furniture cover comprising a plurality of discreet or individual pieces, and to permanently or semi-permanently connect the pieces together to form an attractive well-fitting cover custom-built for a specific furniture configuration. The pieces of such a furniture cover may utilize, for example, a permanent or semi-permanent adhesive to connect the pieces together.

In some embodiments, a water resistant, e.g. waterproof, fastener, such as a waterproof zipper or Velcro® connection, is utilized to limit moisture passage. For example, a waterproof connection between two furniture cover pieces can prevent rain from seeping through the connection to the furniture underneath. In some embodiments, a furniture cover piece comprises a flap, hood, overhang, or other protruding member configured to at least partially cover a connection zone to increase water resistance and/or to make the connection zone more visually appealing.

In some embodiments, each individual furniture cover piece of the overall furniture cover system is sized to fit over one individual furniture piece. For example, a furniture system comprising two seats may be covered by two connected cover pieces, with each piece sized to generally cover one of the two seats. In some embodiments, however, one or more of the furniture cover pieces is of a more generic sizing that may not necessarily match up to a size of an individual furniture piece. In other words, a single modular furniture cover piece may be shaped, sized, or configured to cover a single furniture piece, less than a single furniture piece, more than a single furniture piece, two furniture pieces, or more than two furniture pieces.

In some cases, a modular furniture system may be configured such that there are one or more gaps between furniture pieces, or there may be tables and/or other items positioned between two other furniture pieces. For example, a modular furniture system may be configured such that a small table for holding, for example, drinks or other food items, is positioned between two seats. In such an embodiment, a modular furniture cover system as disclosed herein can be configured to cover the table and both seats in various ways. In one example, the furniture cover system may comprise three pieces, with one piece sized to fit over the left seat, one piece sized to fit over the table, and a third piece sized to fit over the right seat. In another example, the furniture cover system may have two pieces, with a combined length of the two pieces when they are connected together equaling approximately the combined length of the left seat, table, and right seat.

In some embodiments, a bridge or extension cover piece is provided that can bridge a gap between two or more modular furniture cover pieces. For example, if there is a 1 foot gap between two seats, a 1 foot long bridge or extension piece may be utilized to bridge the gap between those two seats, enabling a single unitary furniture cover system comprising a plurality of cover pieces to fit over the entire furniture system.

In some embodiments, a modular furniture cover system comprises one or more end pieces or panels that can be connected to an opening of another cover piece. For example, if a modular furniture cover piece is sized to fit over a single seat, that single furniture cover piece may in some embodiments be sized to cover a front, back, and top of the seat, but not left and right sides of the seat. The furniture cover piece may have an opening on left and right to enable it to potentially connect to another furniture cover piece when, for example, the seat is positioned next to another seat. However, in some cases, the furniture cover may be used to only cover a simple piece of furniture such on a table or a single seat. In some cases the furniture cover is adapted to be able to cover a seat and an adjacent furniture piece on one side. In that case, an end piece or panel may be connected to the left and/or right openings of the furniture cover piece to further enable the cover piece to protect the left and/or right sides of the table, seat, or other component of a furniture grouping.

In some embodiments, individual modular furniture cover pieces or components can be configured or sized to fit specific furniture shapes, such as an end seat, a middle seat, a corner seat, a wedge-shaped seat, a couch, a table, and/or the like. In some embodiments, one or more pieces of a modular furniture cover system can comprise a cord or other securement device for securing the furniture cover to a piece of furniture. For example, the cord or other securement device may be configured to loop around a foot of the furniture to secure the cover to the furniture. The securement device may in some embodiments comprise Velcro®, elastic, rope, cord, snaps, and/or various other materials sufficient to enable securing a furniture cover to a piece of furniture.

Although various embodiments disclosed herein are described with reference to covering of outdoor furniture, it should be understood that the concepts disclosed herein can be used in various applications. For example, a modular cover system could be utilized to cover various seating configurations of boats, motorhomes, cars, and/or the like. Further, the concepts disclosed herein may be utilized to create modular cover systems for automobiles, bicycles, and/or any other item a user desires to protect from the elements. In some embodiments, the concepts and techniques disclosed herein may even be used for other types of situations where the intended use is not protection from the elements. For example, the concepts disclosed herein may be utilized for a modular house cover system, such as to cover a house or other building while that building is being fumigated for pests. Further, the concepts disclosed herein may be utilized for covers for indoor furniture, such as to prevent dust from collecting on furniture during an extended absence from a house, business, etc. Further, while various embodiments described herein refer to a modular furniture cover system that can be configured to fit a modular or configurable furniture system, in some embodiments a furniture cover system can be configured to fit a non-modular or non-configurable piece or pieces of furniture. For example, a modular furniture cover system may in some embodiments enable a user to configure the cover system to fit a particular piece of furniture, and then to reconfigure the cover system to fit a different piece of furniture.

FIG. 1A is a front perspective view of a modular furniture system 100 comprising a plurality of furniture components. The modular furniture system 100 illustrates one example of an outdoor furniture system comprising a plurality of components that have been positioned together to form an L-shaped unitary furniture system. The modular furniture system 100 illustrated in FIG. 1A comprises a left end piece 102, a table 104, a middle piece 106, a corner piece 108, and a right end piece 110. Each of the pieces of furniture comprises a front portion 101, a back portion 103, a top portion 105, and side portions 107. One option to produce a furniture cover for the modular furniture system 100 would be to create a custom fit furniture cover that fits this particular L-shaped furniture configuration. However, since the furniture system is modular, the end user may at any time reposition these furniture component and/or add or remove one or more of the furniture components, which would make the custom fit furniture cover no longer fit the modified configuration of the modular furniture system 100. The disclosure herein provides various embodiments of modular furniture cover systems configured to solve this problem by enabling a user to select the configuration of a modular furniture cover system as appropriate for a particular furniture configuration. When that furniture system is reconfigured, the modular furniture cover system can likewise be reconfigured to produce a close conformance to any configuration of the furniture system.

Figure 1B:
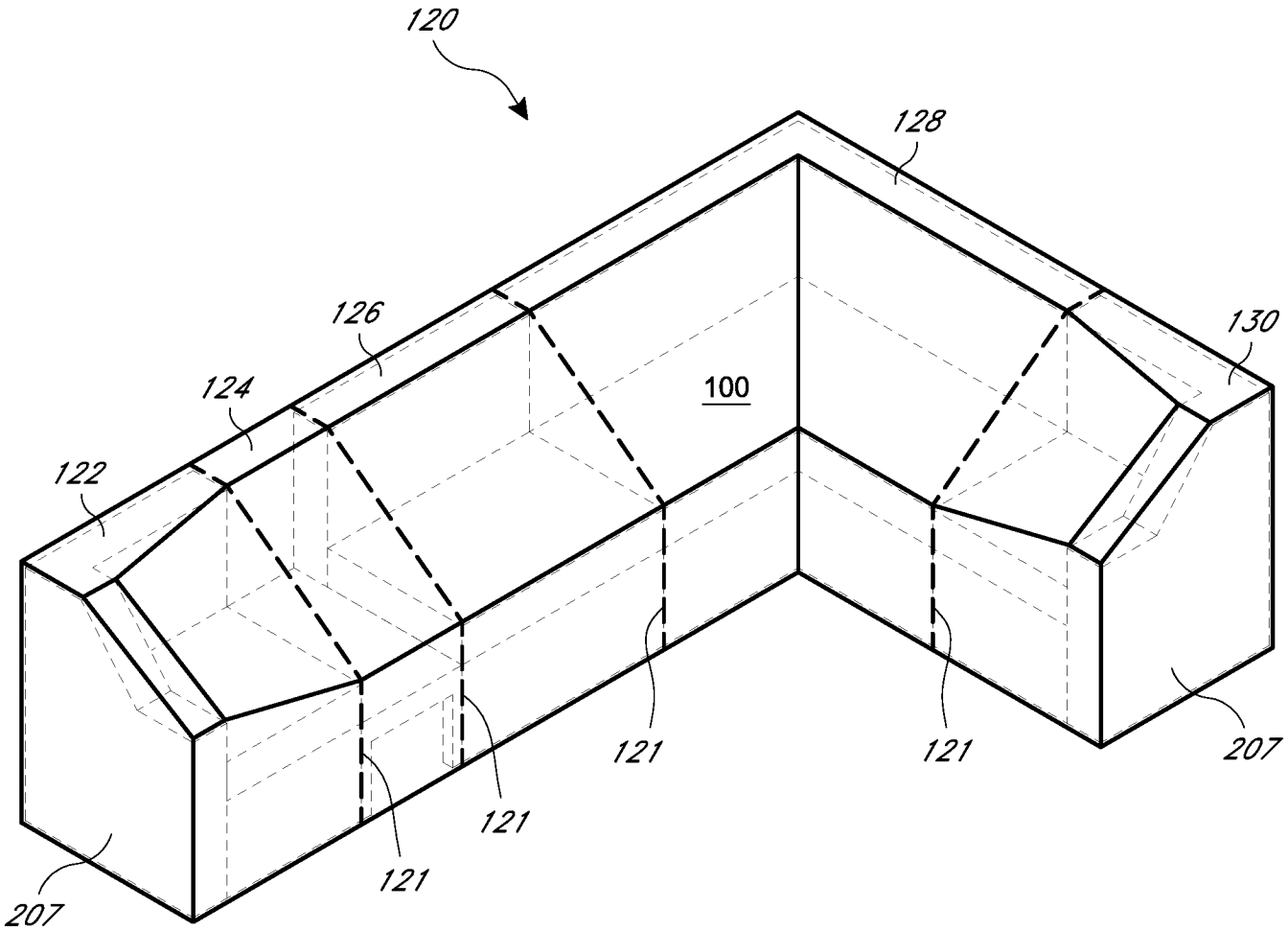
FIG. 1B is a front perspective view of the modular furniture system of FIG. 1A covered with an embodiment of a modular furniture cover system.

FIG. 1B is a front perspective view of the modular furniture system 100 of FIG. 1A (shown in hidden lines) with an embodiment of a modular furniture cover system 120 covering the modular furniture system 100. As can be seen in FIG. 1B, the modular furniture cover system 120 comprises five separate furniture cover pieces that correspond to each of the five separate components of the furniture system 100. Solid lines indicate edges of the cover pieces, and dashed lines indicate connection zones (e.g. joints, connections, fasteners, seams, and the like) where the cover pieces connect to one another. In this embodiment, the modular furniture cover system 120 comprises a left end piece 122 disposed over the left end furniture piece 102, a bridge piece 124 disposed over the table 104, a middle piece 126 disposed over the middle furniture piece 106, a corner piece 128 disposed over the corner furniture piece 108, and a right end piece 130 disposed over the right furniture end piece 110. Each of the furniture cover components is connected to an adjacent furniture component at a connection zone 121. Accordingly, in this embodiment, there are four different connection zones 121 connecting the five different furniture cover components together to create a single unitary furniture cover that fits the modular furniture system 100 neatly.

The connection zones 121 may comprise various different mechanisms to join the different furniture covers together. Some embodiments of mechanisms that may be used to join the various covers are described above and are discussed in more detail below with reference to FIGS. 4A through 4G. In some embodiments, the connection zones 121 can be configured to be water resistant, e.g. waterproof or generally waterproof. With generally waterproof connection zones 121, the modular furniture cover system 120 can keep the elements away from the furniture system 100 as effectively as if the modular furniture cover system 120 were a single custom fit waterproof cover. However, the modular furniture cover system 120 has the added benefit of being configurable to adapt to any reconfiguration of the underlying furniture system 100.

As further described below with reference to FIG. 2A and FIG. 2D, the left end piece 122 and right end piece 130 shown in FIG. 1B each comprise a side surface 207 configured to cover the sides of the left and right end pieces of the furniture system 100. However, in other embodiments, the left end piece 122 and right end piece 130 can be configured to have open ends so that additional furniture components may be connected. For example, FIG. 1C illustrates left and right end pieces having connection zones 121 at their ends for connection to a separate end cover or panel.

Figure 1C:
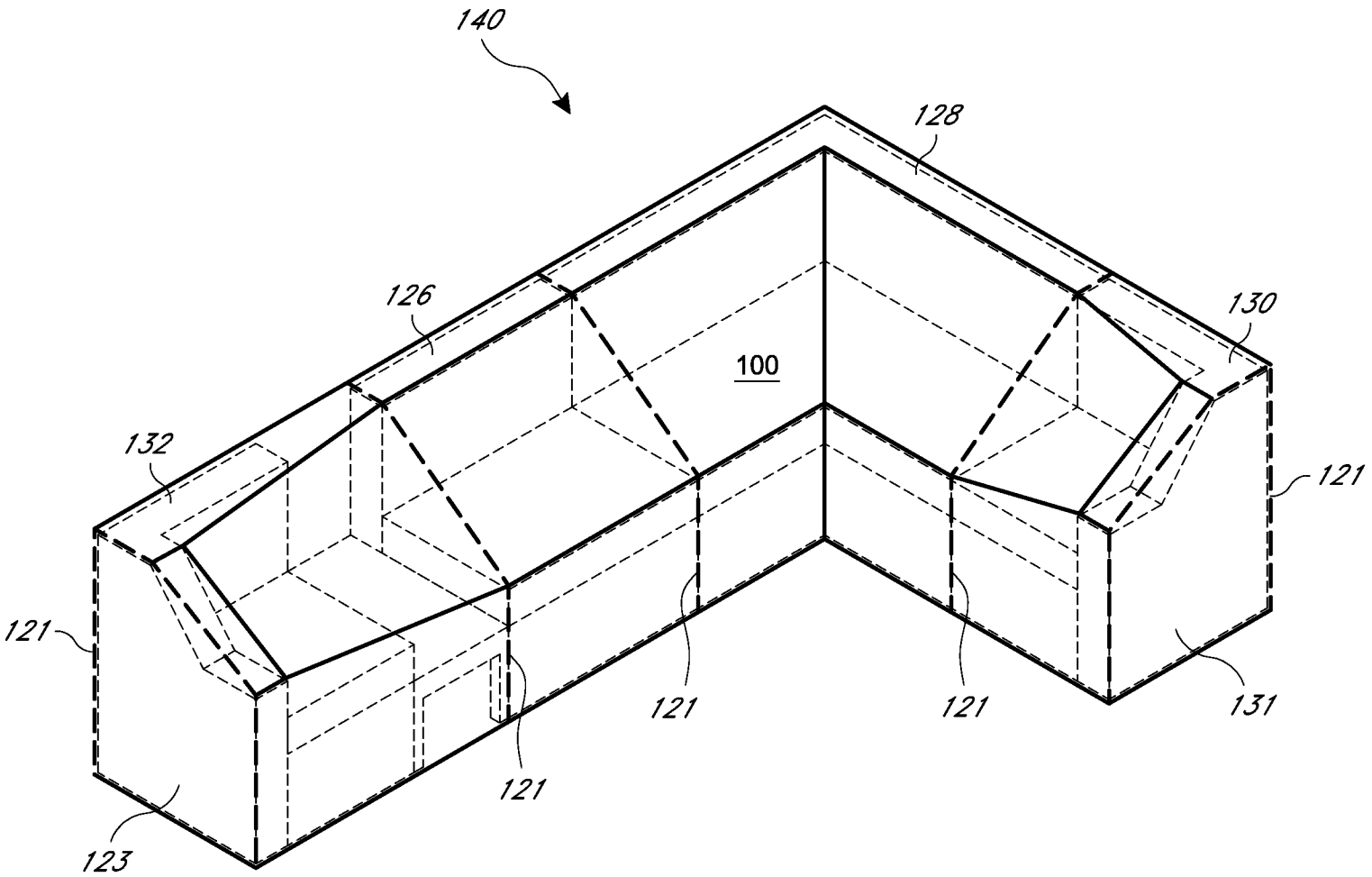
FIG. 1C is a front perspective view of the modular furniture system of FIG. 1A covered with another embodiment of a modular furniture cover system.

FIG. 1C illustrates a front perspective view of the modular furniture system 100 of FIG. 1A with a different modular furniture cover system 140 covering the furniture system. In this embodiment, the furniture cover system 140 is similar to the furniture cover system 120 illustrated in FIG. 1B. However, the furniture cover system 140 comprises an extended left end piece 132 instead of the left end piece 122 connected to the bridge piece 124. This example illustrates that the individual components of the modular furniture cover system do not necessarily have to match a size or length of the furniture pieces underneath the covers. In this case, the left end piece 132 is configured to cover both the left end piece 102 and the table 104 of the modular furniture system 100. In various other embodiments, there may be more or less modular furniture covers in the modular furniture cover system 140. For example, the modular furniture cover system 140 may comprise one, two, three, four, five, six, seven, eight, nine, ten, or more individual cover components that combine together to create a single unitary furniture cover sized for the underlying furniture system 100.

Another difference between the modular furniture cover system 140 and the cover system 120 illustrated in FIG. 1B is that the left end cover 132 comprises an open end that is connected at a connection zone 121 to a left end panel 123. Similarly, the right end piece 130 comprises an open end connected at connection zone 121 to a right end panel 131. As described above, utilizing end panels, such as the left and right end panels 123 and 131, can enable additional furniture components to be added next to the left and right end pieces. If, for example, an additional furniture piece were added next to the right end piece 110, the right end panel 131 could be removed from the right furniture cover end piece 130, and an additional furniture cover piece could be connected to the right end piece 130 to extend the size or length of the modular furniture cover system 140.

The various furniture cover systems disclosed herein may comprise various materials suitable for covering furniture. For example, a furniture cover system may comprise vinyl, leather, cloth, nylon, and/or any other material sufficient to serve the purpose of covering furniture and protecting the furniture from the elements. In some embodiments, the material of a furniture cover system is preferably water resistant, e.g. waterproof. This is because such a cover may be utilized outdoors where it may be subject to rain, dew, water from sprinkler systems, and/or the like. However, in some embodiments, the material may not be water resistant. Such a system may be cheaper to manufacture, and may be ideal for when, for example, a modular cover system is intended to be used indoors as more of a dust cover.

Figure 1D:
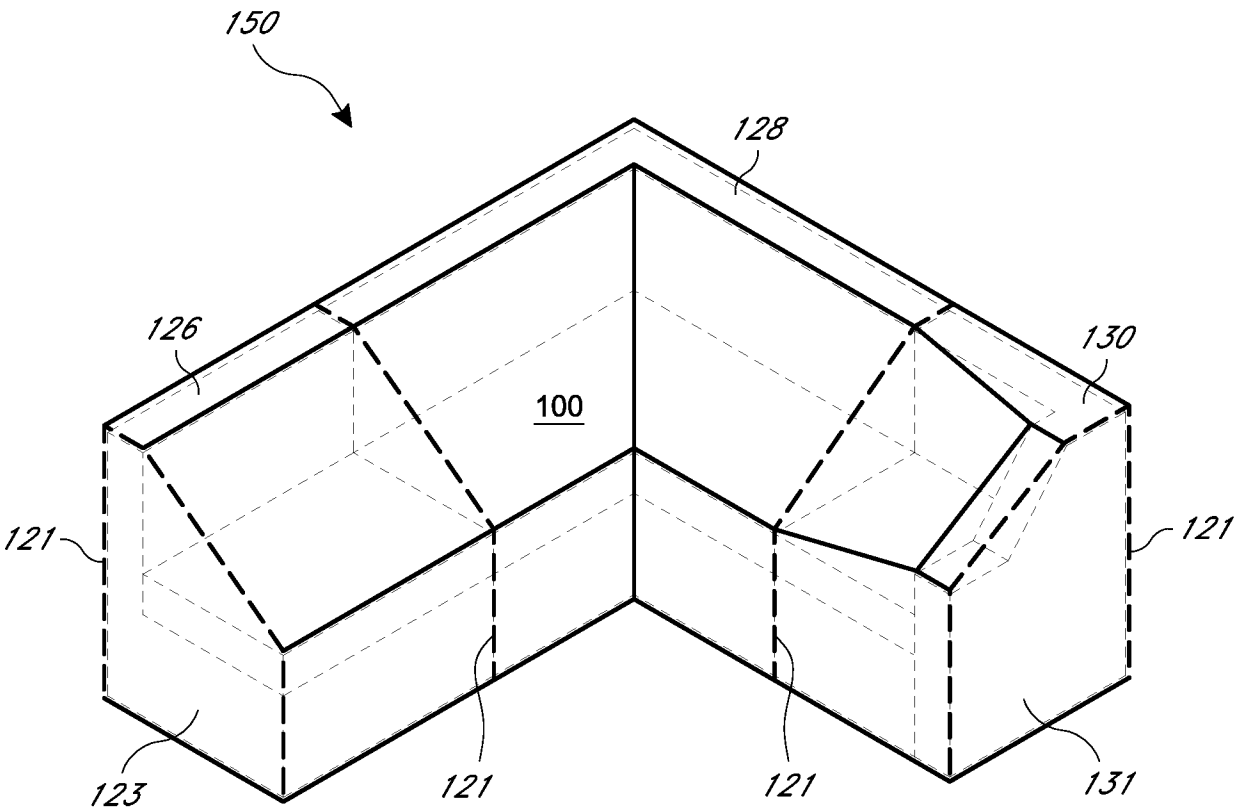
FIG. 1D is a front perspective view of another embodiment of a modular furniture system covered with another embodiment of a modular furniture cover system.

FIG. 1D is a front perspective view of the modular furniture system 100 with the left end piece 102 and table 104 removed. In this case, for example, an end user has chosen to reconfigure the modular furniture system by removing those two components. FIG. 1D further illustrates a modular furniture cover system 150 covering the reconfigured modular furniture system 100. In this case, the modular furniture cover system 150 is similar to the modular furniture cover system 140 illustrated in FIG. 1C. However, the left end piece 132 has been removed, and the left end panel 123 has been moved to connect with the middle piece 126 instead of the left end piece 132. In some embodiments, one end panel may be configured to be used with one or more other furniture cover components. In some embodiments, various end panels may be shaped in different ways to mate with differently-shaped furniture cover components.

In some embodiments, the connection zones 121 are located at a continuous edge of each furniture cover component. Accordingly, in some embodiments, the connection zones 121 each comprise a continuous connector that extends from a bottom of a front surface of a furniture cover, extending around a top surface of the furniture cover, and extending down to a bottom of a back surface of the furniture cover. In other embodiments, a connection zone 121 may not be continuous, may not extend all the way to the bottom, may comprise more than one type of fastener and/or more than one fastener, and/or the like.

In some embodiments, there is no bottom surface of the furniture cover components. In other words, the furniture cover system is configured to slip over furniture components from the top, with the bottom remaining open. However, in some embodiments, the furniture cover system may be configured to have a bottom surface that partially or fully encases the furniture system within the furniture cover. In some embodiments, the furniture covers can comprise a strap, rope, loop, and/or various other features to help hold the cover onto the furniture by attaching a portion of the furniture cover to, for example, a leg of the furniture component, or by attaching a bottom front surface of the furniture cover to a bottom back surface of the furniture cover, by extending a strap along a bottom of a furniture component, and/or the like. It should be noted that these are merely illustrative examples, and one of skill in the art would understand various other methods of retaining the furniture cover to the underlying furniture may be utilized.

FIGS. 2A through 2G are front perspective views of various embodiments of modular furniture cover pieces. Each of these figures illustrates a different modular furniture cover piece or component that is configured to be a specific size and/or to fit over a specific furniture component, and to either act as its own furniture cover over a single furniture component or to connect with one or more of the other furniture cover pieces or components to create a larger unitary structure.

Figures 2A, 2B, 2C, 2D:
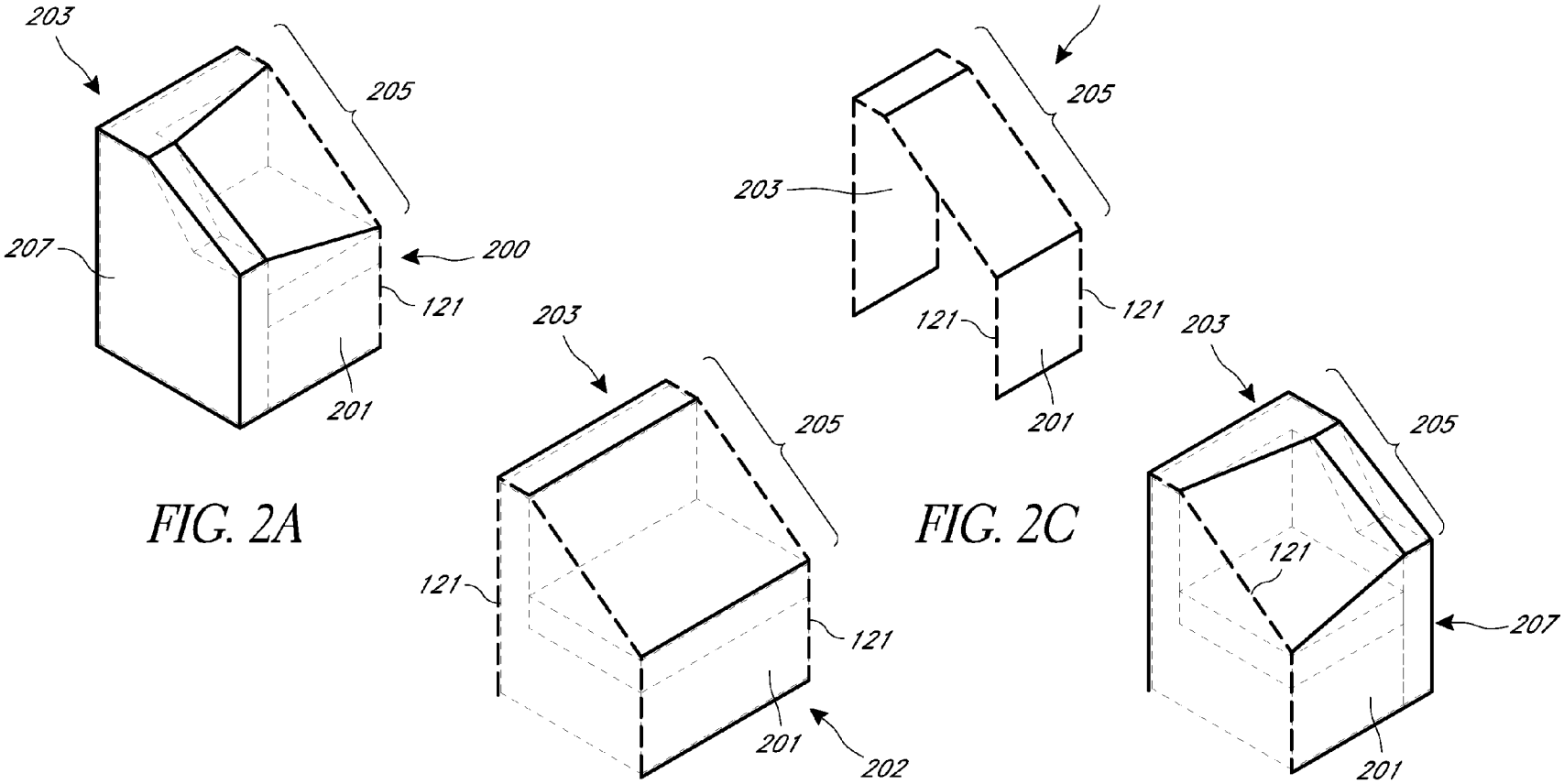

FIG. 2A is a front perspective view of a left end piece 200. The left end piece 200 is configured to fit over a left end furniture piece, such as the left end piece 102 illustrated in FIG. 1A. The left end piece 200 comprises a front surface 201, a back surface 203, a top surface 205, and a side surface 207. The left end piece 200 further comprises one connection zone 121 located adjacent a continuous edge formed by the front surface 201, the top surface 205, and the back surface 203. It should be noted that the front surface 201, back surface 203, and top surface 205 are intended to define general areas or portions of the furniture cover in this and other embodiments and are not necessarily limited to being flat surfaces. In this embodiment, the front surface 201 refers to a generally flat surface configured to cover a front portion of the underlying furniture piece. The back surface 203 refers to a generally flat portion configured to cover a back portion of the underlying furniture piece. The top surface 205 refers to a portion or area of the cover that includes a plurality of surfaces that are configured in some embodiments to at least partially conform to the underlying furniture piece. Accordingly, when referring herein to a top surface, front surface, or back surface of a furniture cover, these terms are intended to refer generally to a specific portion or area of a furniture cover, but not necessarily to a single flat surface. In some embodiments, one or more front, back, and/or top surfaces or areas of a furniture cover may be flat, curved, jagged, rounded, and or the like. When referring to, for example, the front surface 201, this means an area or portion of the cover intended to generally cover a frontal area of the underlying furniture component. Likewise, a top surface and back surface is configured to generally cover or protect a top or back area of an underlying furniture component. Although the discussion above is focused on front, top, and back surfaces, the same concepts can be applied to other surfaces, such as the side surface 207.

FIG. 2B illustrates a front perspective view of a middle piece 202 of a modular furniture cover system. The middle piece 202 can be configured to cover, for example, the middle piece 106 of the modular furniture system 100. Similarly to the left end piece 200 of FIG. 2A, the middle piece 202 comprises a front surface 201, a back surface 203, and a top surface 205. However, the middle piece 202 comprises two open ends defined by two connection zones 121. The middle piece 202 does not have a side surface, such as the side surface 207 illustrated in FIG. 2A. This can enable the middle piece 202 to connect to other modular furniture system components or pieces on either side of the middle piece 202. In some embodiments, one or more of the connection zones 121 may be connected to an end panel, such as the end panel 212 illustrated in FIG. 2G, to enable the middle piece 202 to either cover a single furniture component or to act as an end piece, similar to the left end piece 200 illustrated in FIG. 2A.

FIG. 2C illustrates a front perspective view of a bridge piece 204 of a modular furniture cover system. The bridge piece 204 is identical in design to the middle piece 202 illustrated in FIG. 2B, except the bridge piece 204 is narrower than the middle piece 202. The bridge piece 204 is intended to be an extension or bridge component that can bridge a gap between two furniture pieces. For example, as illustrated in FIG. 1A, the table 104 creates a gap between the left end piece 102 and the middle piece 106. Accordingly, a bridge piece 204 having approximately a same width as the table 104 can be utilized to bridge the gap between the left end piece 102 and the middle piece 106. Although in this example the bridge piece 204 is described as being of a length sufficient to bridge a particularly sized gap, the bridge piece 204 may in some embodiments be used simply to adjust the length of a furniture cover component. For example, the middle piece 202 may have a width that is shorter than an underlying furniture component. In that case, one or more bridge pieces 204 may be connected to the middle piece 202 to extend its width. By doing this, the furniture cover components can be combined together to create a custom size that matches any underlying furniture system configuration.

FIG. 2D is a front perspective view of a right end piece 206 of a modular furniture cover system. The right end piece 206 is similar to the left end piece 200 illustrated in FIG. 2A. However, the right end piece 206 is intended to be used to cover a right end piece, such as the right end piece 110 of the modular furniture system 100 illustrated in FIG. 1A instead of the left end piece 102.

FIG. 2E is a front perspective view of an embodiment of a corner piece 208 of a modular furniture cover system. The corner piece 208 is configured to cover a corner piece of a modular furniture system. For example, the corner piece 108 illustrated in FIG. 1A could be covered by a corner piece similar to the corner piece 208 illustrated in FIG. 2E. Note, however, that the specific corner piece 208 illustrated in FIG. 2E would likely not be wide enough to cover the entire corner piece 108 of the modular furniture system 100. Accordingly, a user could attach an extension or bridge piece, such as the bridge piece 204 to both the left and right sides of the corner piece 208 to make the corner piece larger or wider to fit the underlying furniture system. In another embodiment, the corner piece 208 is made wider to fit the corner piece 108 without using bridge pieces.

As with the middle piece 202 illustrated in FIG. 2B, the corner piece 208 comprises a front surface 201 and a top surface 205. However, due to the configuration of the corner piece 208 being configured to cover a corner furniture piece, the corner piece 208 comprises two back surfaces 203 instead of a single back surface 203, the two back surfaces 203 being at roughly a 90° angle. In some embodiments, the two back surfaces 203 may be considered to be a single back surface, even though it is not a flat back surface. Further, as with the various embodiments disclosed herein, the top surface 205 is not necessarily a flat surface. In this embodiment, the top surface 205 comprises an L-shaped flat surface at a very top of the cover, and angled surfaces that extend from the flat top surface to the connection zones 121 and the front surface 201.

FIG. 2F illustrates a wedge piece 210 of a modular furniture cover system. The wedge piece 210 is similar in design to the corner piece 208, except the wedge piece 210 is configured to cover a furniture component that fits in a corner with a rounded shape instead of with a perpendicular or 90° back surface. The wedge piece 210 comprises a front surface 201, a top surface 205, and a back surface 203. Further, the wedge piece 210 comprises openings at left and right ends defined by two connection zones 121. As with other embodiments, the connection zones 121 can be connected to one or more other furniture component pieces and/or an end panel.

FIG. 2G illustrates a front perspective view of an end panel 212 of a modular furniture cover system. The end panel 212 in this embodiment comprises a generally flat panel having a connection zone 121 configured to connect to a mating connection zone at an opening of another furniture component, such as any of the furniture components illustrated in FIGS. 2A through 2F.

Figure 3A:
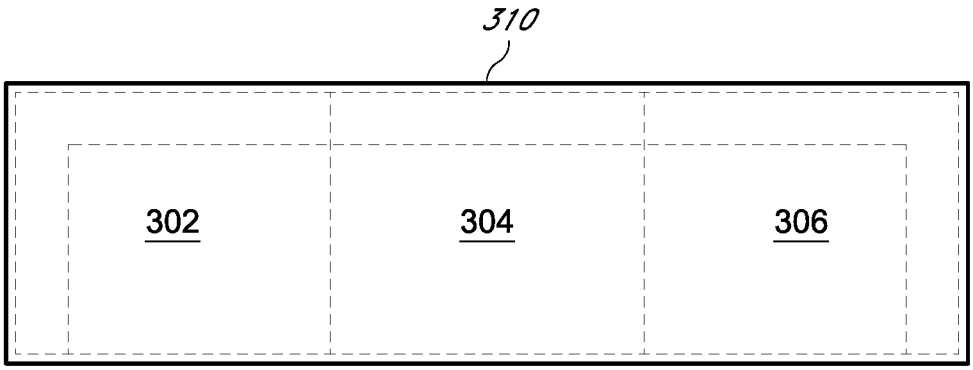
FIGS. 3A-3F are top views of various embodiments of modular furniture cover systems covering a modular furniture system.

FIGS. 3A through 3F are top views of various embodiments of furniture cover systems. These embodiments are intended to illustrate that modular furniture cover systems as disclosed herein can be configured in various ways. FIG. 3A illustrates a top view of an example furniture cover system, having a single furniture cover 310. The single furniture cover 310 is covering a modular furniture system comprising three pieces shown in hidden lines, the pieces being a left end piece 302, a middle piece 304, and a right end piece 306. Although not shown in this view, in some embodiments the furniture cover 310 may comprise one or more connection zones at its sides for connection to one or more end panels. This configuration may be similar to the configuration described above with reference to FIG. 2B.

Figure 3B:
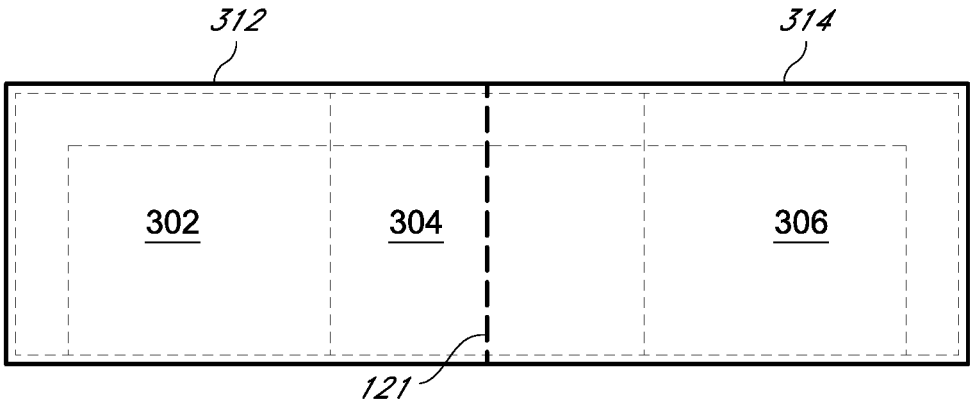
Figure 3C:
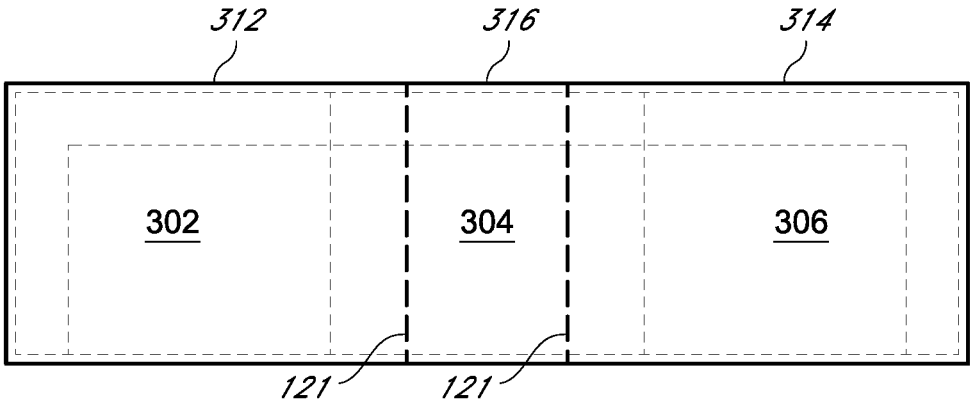

FIG. 3B illustrates a top view of a furniture cover system comprising a left end piece 312 connected to a right end piece 314 at a connection zone 121. The left end piece 312 and right end piece 314 are configured to combine together to cover the same three furniture pieces as in FIG. 3A. In this embodiment, each of the left and right end pieces 312 and 314 are sized as approximately half of the total length of the underlying furniture. However, if a furniture cover system is not specifically designed for any specific furniture configuration, it may not line up in this way. FIG. 3C illustrates an embodiment wherein the left end piece 312 and right end piece 314 are not of a sufficient length together to cover the three underlying furniture pieces. Accordingly, a middle piece 316 or bridge or extension piece has been added between the left end piece 312 and right end piece 314 to enable the furniture cover system to neatly fit over the entire underlying furniture system. In this case, there are two connection zones 121, with the left-most connection zone 121 connecting the left end piece 312 to the middle piece 316, and the right-most connection zone 121 connecting the middle piece 316 to the right end piece 314.

Figure 3D:
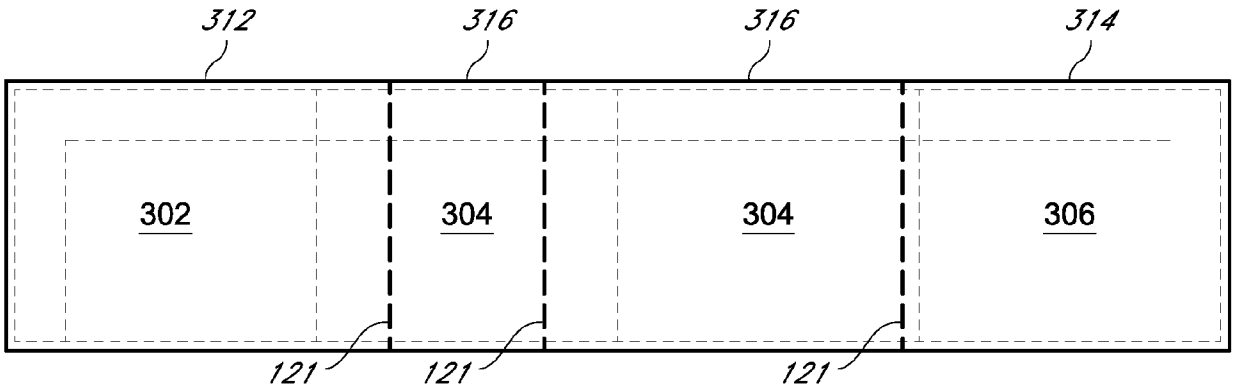

FIG. 3D illustrates an embodiment wherein an additional middle furniture piece 304 has been added to the furniture system. Accordingly, the furniture cover system has also been reconfigured to still generally conform to the underlying furniture system. A second middle piece 316 has been added to the furniture cover system of FIG. 3C. Accordingly, the furniture cover system illustrated in FIG. 3D comprises four components, namely a left end piece 312, a right end piece 314, and two middle pieces or extension pieces 316. There is a single connection zone 121 between each of the four furniture cover components.

Figure 3E:
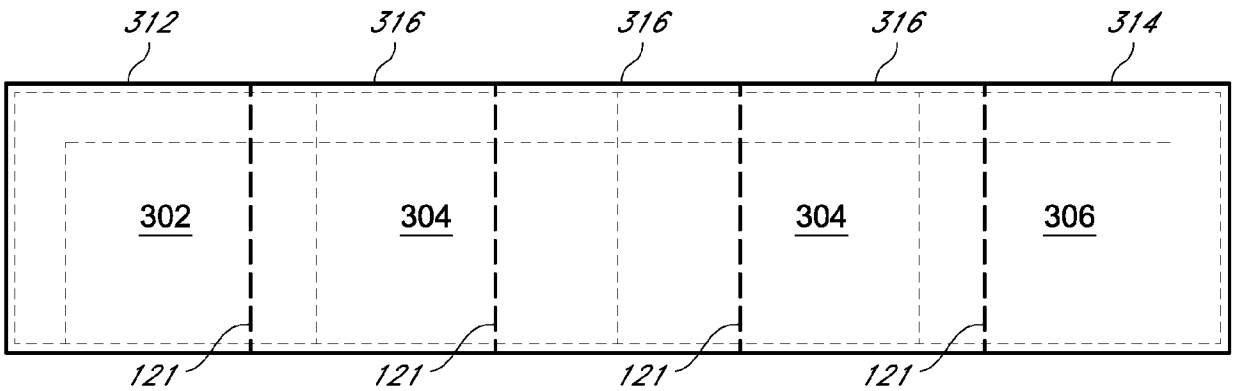

FIG. 3E depicts another example of how a modular furniture cover system may be configured to cover the furniture system configuration illustrated in FIG. 3D. In this case, the furniture cover system comprises five furniture cover pieces or components that are all generally the same width. In this case, the system comprises a left end piece 312, a right end piece 314, and three middle pieces 316. However, in some embodiments, the system may comprise five pieces that are identical to each other, with the left and right end pieces being connected to an end panel, such as the end panel illustrated and discussed above with reference to FIG. 2G.

Figure 3F:
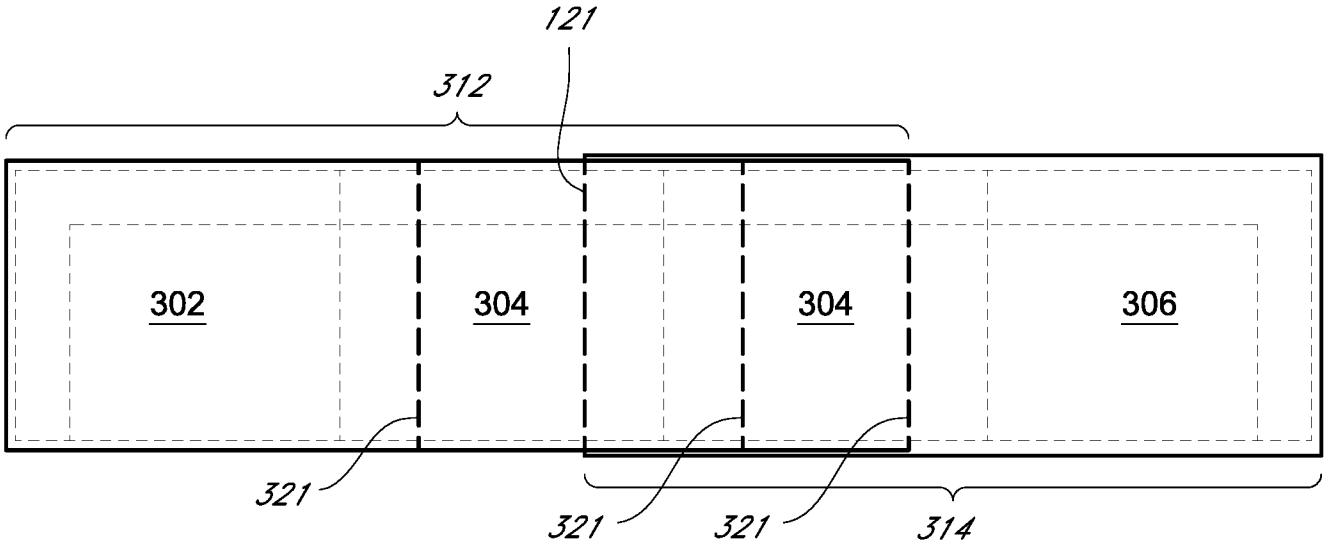

Although most of the embodiments disclosed herein have been disclosed with reference to one furniture cover component connecting to another furniture cover component at an end opening of each furniture cover component, in various embodiments, the modular furniture cover components may be configured to have a plurality of potential connection zones, not necessarily at an end of the component. For example, as illustrated in FIG. 3F, a left end piece 312 comprises four different potential connection zones that may be used to connect the left end piece 312 to a right end piece 314. An overall length of the furniture cover system comprising the left and right end pieces 312 and 314 can be modified by utilizing the different connection zones. In this case, the left end piece 312 comprises three different currently-unused connection zones 321, and one connection zone 121 that is currently being used. The right end piece 314 in this embodiment comprises a single connection zone 121 which is attached to the left end piece 312, with the right end piece 314 overlapping the left end piece 312 for at least a portion of the length of the right end piece 314. The configuration in this example is similar to the configuration described below with reference to FIG. 4G, although the example shown in FIG. 4G comprises just one used connection zone 408 and one unused connection zone 421. As can be seen in FIG. 3F, using the depicted left end piece 312 and right end piece 314, the modular furniture cover system could be configured to be at least four different overall lengths, depending on where the connection zone 121 of the right end piece 314 is connected to the left end piece 312. In various other embodiments, end pieces may have any number of discreet connection zones for connection to another cover piece, such as one, two, three, four, five, six, seven, eight, nine, ten, or more.

FIGS. 4A through 4G illustrate cross-sectional views of various embodiments of connection zones that may be utilized to connect two modular furniture cover components together. For example, the various connection zones illustrated in FIGS. 4A through 4G may be utilized at the various connection zones 121 described with reference to FIGS. 1B through 1D, FIGS. 2A through 2G, and FIGS. 3B through 3F.

Figure 4A:
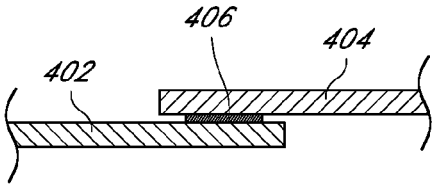
FIGS. 4A-4G are cross-section views of various embodiments of connection zones utilized to connect one modular furniture cover to another modular furniture cover.

FIG. 4A comprises a first cover 402 and a second cover 404 connected using a hook and loop or Velcro® fastener 406. For example, the first cover 402 may be the left end piece 122 illustrated in FIG. 1B, and the second cover 404 may be the bridge piece 124 illustrated in FIG. 1B, with the Velcro® fastener 406 being part of the connection zone 121 between those two components.

Figure 4B:
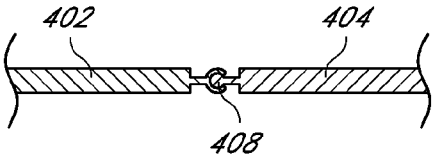
Figure 4C:
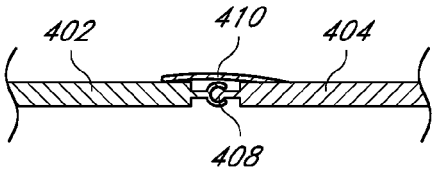

FIG. 4B illustrates a first cover 402 connected to a second cover 404 using a zipper fastener 408. FIG. 4C illustrates the left or first cover 402 connected to the second cover 404 using the zipper fastener 408, but also including a flap or shield 410. The flap or shield 410 can be configured to cover the zipper fastener to, among other things, increase the water resistant properties of the connection zone and/or to make the connection zone more visually appealing.

Figure 4D:
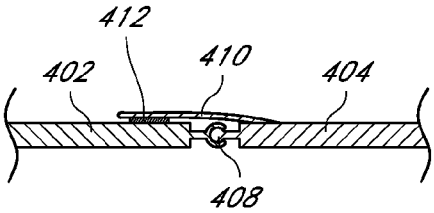

FIG. 4D illustrates another connection zone similar to the connection zone illustrated in FIG. 4C. However, in FIG. 4D, a Velcro® fastener or hook and loop fastener 412 is added to the shield 410. This can help to keep the shield 410 in place over the zipper fastener 408 to further increase the water resistance of the connection zone and/or to increase the attractiveness of the cover system. In some embodiments, a cover system may be configured to be configured by a user to match a shape of underlying furniture, but may be configured to remain in that shape for an extended period of time, maybe even years or more. Accordingly, it can be advantageous to make the connection zones between various components as durable and attractive as possible. A shield 410 over a connection zone, with the shield attaching to the first cover 402 can help to make a more seamless appearance of the cover system.

Figure 4E:
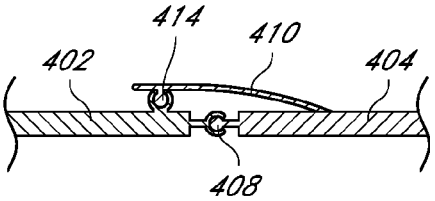

FIG. 4E illustrates another connection zone similar to the connection zone illustrated in FIG. 4D. However, in this case, the flap 410 is connected to the first cover 402 utilizing a zipper or zip style fastener, such as a Ziploc® bag style seal 414 instead of a Velcro® fastener 412.

Figure 4F:
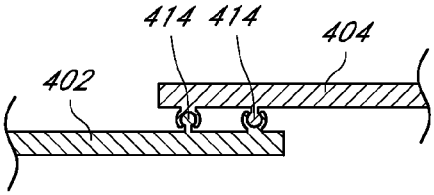

FIG. 4F illustrates another example of connecting a first cover 402 to a second cover 404. In this case, the first cover 402 is connected to the second cover 404 utilizing a zip style fastener, such as a Ziploc® bag style double seal 414. For example, the second cover 404 may be laid over the top of the first cover 402, and the two may lock together by applying pressure between the two.

Figure 4G:
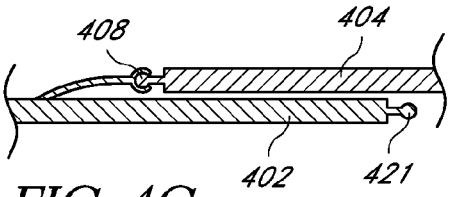

FIG. 4G illustrates an example of a first cover 402 having a plurality of zipper or other style of connection zones that can be connected to by the second cover 404. This can be, for example, similar to the furniture cover system depicted in FIG. 3F, where an overall length of the furniture cover system can be set depending on which connection zone is utilized. In this case, a zipper fastener 408 at a left side of FIG. 4G connects the second cover 404 to the first cover 402. An unused zipper connection zone 421 is shown at a right end of FIG. 4G. If, for example, the second cover 404 were disconnected from the zipper connection zone 408 and connected to the zipper connection zone 421, this likely would increase an overall length or width of the furniture cover system.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present invention herein disclosed should not be limited by the particular disclosed embodiments described above.

What is claimed is:

1. A furniture protection system comprising:

a first cover portion comprising a front surface and a back surface interconnected by a top surface, the first cover portion configured to substantially cover a front, back, and top surface of a first furniture component;

a second cover portion comprising a front surface and a back surface interconnected by a top surface, the second cover portion configured to substantially cover a front, back, and top surface of a second furniture component;

an end panel comprising a surface configured to substantially cover a side surface of the first or second furniture components, wherein a first lateral edge of the first cover portion, formed by the front surface, back surface, and top surface of the first cover portion, comprises a first releasable fastener for connecting the first cover portion to the second cover portion or the end panel, wherein a second lateral edge of the second cover portion, formed by the front surface, back surface, and top surface of the second cover portion, comprises a second releasable fastener configured to engage the first releasable fastener, wherein a peripheral edge of the end panel comprises a third releasable fastener configured to engage the first releasable fastener, wherein, when the first cover portion is connected to the end panel, a furniture cover assembly capable of substantially covering the first furniture component is formed, and wherein, when the first cover portion is connected to the second cover portion, a furniture cover assembly capable of substantially covering simultaneously the first furniture component and second furniture component is formed; and a bridge panel to connect the first cover portion to the second cover portion, the bridge panel comprising a fourth releasable fastener configured to connect to the first releasable fastener and a fifth releasable fastener configured to connect to the second releasable fastener.

2. The furniture protection system of claim 1, wherein the first cover portion comprises a third lateral edge opposite the first lateral edge, the third lateral edge comprising a sixth releasable fastener.

3. The furniture protection system of claim 1, wherein the first and second releasable fasteners form a substantially waterproof joint when connected.

4. The furniture protection system of claim 1, wherein the first and second releasable fasteners comprise at least one of a hook and loop fastener and a zipper.

5. A furniture cover system comprising:

a first furniture cover configured to at least partially cover at least one of a top, front, or back of a first furniture component, the first furniture cover comprising a first releasable fastener positioned adjacent to a first edge;

a second furniture cover configured to at least partially cover at least one of a top, front, or back of a second furniture component, the second furniture cover comprising a second releasable fastener positioned adjacent to a second edge;

an end panel comprising a surface configured to at least partially cover a side of the first furniture component, the end panel comprising a third releasable fastener positioned adjacent a peripheral edge, wherein the first and second furniture covers are configured to connect together, using the first and second releasable fasteners, to form a combined cover capable of at least partially covering the first and second furniture components, and wherein the first furniture cover and the end panel are configured to connect together, using the first and third releasable fasteners, to form a combined cover capable of at least partially covering the side of the first furniture component and at least one of the top, front, or back of the first furniture component; and a bridge panel to connect the first furniture cover to the second furniture cover, the bridge panel comprising a fourth releasable fastener configured to connect to the first releasable fastener and a fifth releasable fastener configured to connect to the second releasable fastener.

6. The furniture cover system of claim 5, wherein the first and second releasable fasteners form a substantially waterproof joint when connected.

7. The furniture cover system of claim 5, wherein the first and second releasable fasteners comprise at least one of a hook and loop fastener and a zipper.

* * * * *